United States Patent [19]

Karnofsky

[11] 4,167,470

[45] Sep. 11, 1979

[54] PROCESS AND APPARATUS FOR SOLVENT EXTRACTION OF OIL FROM OIL-CONTAINING DIATOMITE ORE

[76] Inventor: George B. Karnofsky, 1163 Firwood Dr., Pittsburgh, Pa. 15243

[21] Appl. No.: 905,861

[22] Filed: May 15, 1978

[51] Int. Cl.[2] ..... C10G 17/00

[52] U.S. Cl. ..... 208/8 LE; 208/11 LE

[58] Field of Search ..... 208/8 LE, 11 LE

[56] References Cited

U.S. PATENT DOCUMENTS 4,057,486 11/1977 Meadus et al. ..... 208/11 LE

*Primary Examiner*—Herbert Levine
*Assistant Examiner*—Joseph A. Boska

[57] ABSTRACT

A process for solvent extraction of oil from oil bearing diatomite ore and an apparatus for use therewith, wherein the ore is extracted by countercurrent decantation with a hydrocarbon solvent, solvent is recovered from the extract by multiple effect evaporation followed by stripping, and the spent diatomite is contacted with water to displace a major portion of the solvent therefrom, and solvent is recovered from the aqueous slurry of the spent diatomite by stripping with steam at superatmospheric pressure.

17 Claims, 1 Drawing Figure

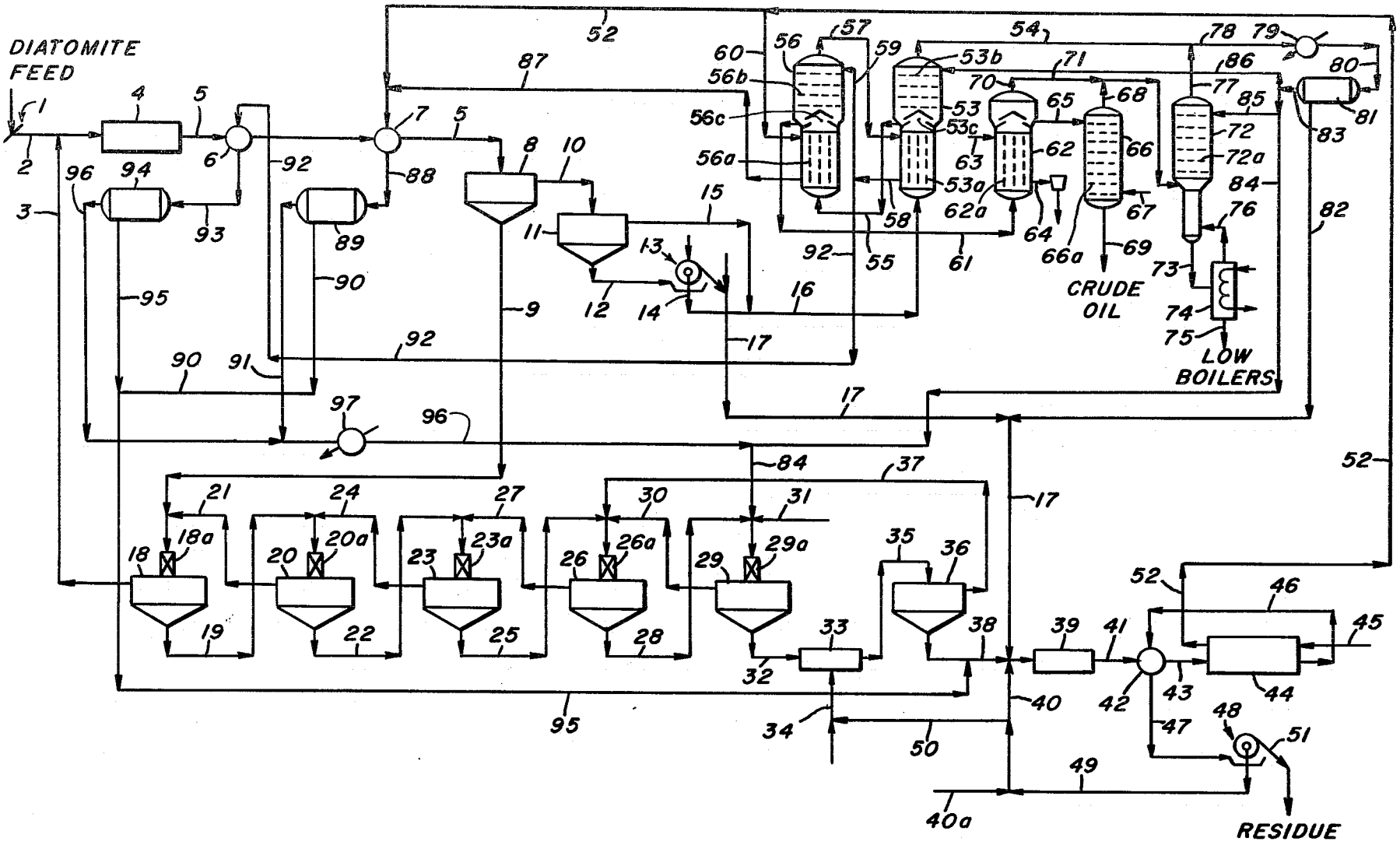
DIATOMITE FEED
CRUDE OIL
LOW BOILERS
RESIDUE

PROCESS AND APPARATUS FOR SOLVENT EXTRACTION OF OIL FROM OIL-CONTAINING DIATOMITE ORE

BACKGROUND OF THE INVENTION

The present invention provides an efficient method for solvent extraction of crude oil from oil-impregnated diatomite ore. The ore is comprised of a base of diatoms, hollow siliceous skeletons of single celled animals, which are cemented by oil and water into soft aggregates. One such diatomaceous ore deposit, which is impregnated with crude oil characteristic of the area, is located in the United States at McKittrick, California. Such deposits, in addition to the oil-impregnated diatomaceous particles, also contain some fine clay, silt and water. A typical such diatomite ore, which contains about 12 percent oil and 34 percent water strongly absorbed in the hollow diatom skeletons, is a friable solid, slightly unctuous but not damp.

I am aware of no prior art which relates specifically to the solvent extraction of oil from diatomite ore, although solvent extraction processes for separating heavy bitumens from tar sands have previously been proposed but have not gained commercial acceptance. Tar sands are defined as sands cemented by a bitumen too viscous to be recovered by conventional crude oil production methods. Although diatomite is sometimes classified as a tar sand, their properties from the point of view of solvent extraction are so different that such a classification is misleading and incorrect.

It is well known to the art that any solvent extraction process employing a volatile solvent which must be recovered comprises the steps of preparation for extraction, extraction, recovery of solvent from spent solids and recovery of solvent from the extract. Diatomite ore requires little preparation, since it is a soft friable solid which disintegrates when mixed with solvent. The present process employs countercurrent decantation to extract oil from diatomite ore with a hydrocarbon solvent. Countercurrent decantation, well known to those skilled in the art of extraction, is carried out in multiple stages, each of which comprises a mixer and a thickener. It is well known to recover solvent from spent solids by vaporization. However, diatomite is unique in that the individual particles are of microscopic size, so that desolventizing of dry diatomite is not practical because of the large amount of dust which would be entrained with the vapor. Recovery of solvent from a non-volatile liquid extract by multiple effect evaporation followed by steam stripping is known. Separation of solvent from crude oil poses the additional problem that there are low boilers in the crude oil, an appreciable amount of which distill with the solvent and must be separated from it before the solvent is recycled to the extraction system.

BRIEF SUMMARY OF THE INVENTION

Oil is recovered from oil-containing diatomite ore by a solvent extraction process employing continuous countercurrent decantation, wherein a previously formed second miscella of oil in hydrocarbon solvent is mixed with the ore to form a slurry. The slurry is heated to near the boiling point of the solvent and charged to the first thickener of the multi-stage countercurrent decantation system, each stage comprising a mixer and thickener. Diatomite underflowing the first thickener is further contacted with hydrocarbon solvent in a plurality of countercurrent extraction stages. Said second miscella overflows the second thickener of the second extraction stage. Spent diatomite exiting the last extraction stage, still containing residual solvent, is first contacted with water to separate a major portion of residual solvent therefrom, and then with steam at superatmospheric pressure to vaporize all of the residual solvent. The solvent is condensed and recycled to the countercurrent extraction process.

First miscella overflowing the first thickener is clarified to remove ore fines and then evaporated to recover oil substantially free of solvent. The evaporation system, comprising multiple effect evaporators, an oil stripper and a still is designed to separate solvent, crude oil and a low boiling fraction of the crude oil that distills with the solvent.

DESCRIPTION OF THE DRAWING

The drawing is a schematic view of apparatus usable in the present process and a flow diagram of the process.

DETAILED DESCRIPTION

According to the present process, oil contained in a diatomaceous deposit is removed therefrom by solvent extraction. The diatomite ore, which contains oil, water and some fine clay or silt, is mined and, if necessary, crushed so as to reduce the ore to a lump size of below three-quarters of an inch.

As shown schematically in the drawings, crushed diatomite ore is introduced through a seal 1, into a duct 2 into which hot second miscella is also fed through line 3. The mixture of the diatomite ore at ambient temperature and hot miscella is charged from duct 2 into the first stage feed mixer 4 where the mixture is thoroughly agitated so as to completely disintegrate the diatomite and form a slurry. Slurry from first stage mixer 4 is passed through duct 5 through first and second heat exchangers 6 and 7, where the slurry is reheated to a preferred extraction temperature slightly below the boiling point of the heterogeneous azeotrope of solvent and water.

The heated slurry is discharged from duct 5 into a settling zone which may comprise a first stage thickener 8 where the particles of diatomite settle to the bottom as a thixotropic mud for removal through underflow pipe 9 for further extraction. Overflow from thickener 8, which comprises the first miscella, containing oil, solvent and ore fines, enters overflow pipe 10 and is charged to miscella clarifier 11. In the miscella clarifier, fine solid material present in the miscella settles to the bottom. Underflow from the clarifier 11 is discharged through line 12 to a continuous filter 13 (portrayed as a rotary drum vacuum filter although other filters known to the art might be used), where the underflow mixture of miscella and solids is filtered and the solid filter cake formed therein washed with solvent to remove substantially all of the remaining oil. Even though the individual particles of diatomite are of very fine size, they filter readily from the miscella, as might be expected since diatomite is an excellent filter aid. Filtrate from the filter 13 in pipe 14 is combined with overflow from the clarifier 11 in line 15, and the combined miscella in line 16 is charged to the evaporation system described hereinafter. Filter cake from the filter 13 discharged through duct 17 is conveyed to the residue stripper, later described.

The diatomite mud separated from the first miscella in the first stage thickener 8 is discharged through underflow pipe 9, and next flows through a series of extraction stages comprising mixers and thickeners. From underflow pipe 9 the underflow is charged to the second stage thickener 18 through mixer 18*a*, which is portrayed as an in-line mixer in which liquids and solids are mixed by concurrent flow past baffles. However, other mixers can be used, as is well known to those skilled in the art. Overflow from the second stage thickener 18 is discharged therefrom to line 3 for recycle and admixture with fresh diatomite in duct 2 as previously described. Bottoms from second stage thickener 18 flow through line 19 to the third stage mixer 20*a*. Overflow from the third stage thickener 20 flows through line 21 to the second stage mixer 18*a*. This sequence is continued through the fourth through sixth extraction stages. Underflow from third stage thickener 20 flows through line 22 to the fourth stage mixer 23*a*. Overflow from the fourth stage thickener 23 flows through line 24 to the third stage mixture 20*a;* underflow from thickener 23 flows in line 25 to the fifth stage mixer 26*a*. Overflow from fifth stage thickener 26 flows through line 27 to the fourth stage mixer 23*a;* underflow from thickener 26 flows through line 28 to the sixth stage mixer 29*a*. Overflow from the sixth stage thickener 29 flows through line 30 to the fifth stage mixer 26*a*. Oil-free solvent recycled from solvent condensers is fed to sixth stage mixer 29*a* through line 84, as is later described. Since some solvent is lost in the process, make-up solvent is provided in line 31.

By these means, countercurrent multistage extraction is accomplished. This extraction sequence, known as countercurrent decantation, brings the freshest solvent into contact which the most spent solids; the concentrated miscella is last contacted with the feed solids.

It is to be understood that pumps (not shown in the drawing) may be required to transfer underflow and overflow from each thickener to their respective destinations. It is also to be understood that, although conventional thickeners are portrayed, other settlers, such as the so-called lamellar separator, may be employed.

The underflow from sixth stage thickener 29, which comprises spent diatomite containing residual solvent that still has a small oil content, is discharged by means of line 32 into the solvent disengaging mixer 33, where the spent diatomite is mixed with water fed through line 34 to form an emulsion. The mixture then flows through line 35 to the solvent disengager 36 wherein there is produced an aqueous slurry of spent diatomite which still entrains about one quarter of the solvent in the underflow from thickener 29, and a less dense solvent phase. The solvent disengager portrayed in the drawing is in effect a thickener equipped with a "picket-fence" rake which cuts through the emulsion and releases the disengaged solvent to float to the top of the disengager, from which it overflows. The emulsion is equally well broken by moderate centrigual force, as applied in a centrifuge or hydrocyclone. Solvent disengagement is effected so as to reduce to a minimum the amount of solvent which must be subsequently removed from the spent diatomite ore by use of heat. The amount of water added to the underflow in the disengaging step should be that needed to bring the water content of the spent diatomite phase to a minimum of two parts by weight water per part by weight of spent diatomite.

Overflow solvent from the disengager 36 is returned in line 37 to the fifth stage mixer 26*a* for admixture with underflow from line 25 and overflow from line 30 for reuse in the extraction process.

The aqueous slurry of spent diatomite which still contains some residual solvent is discharged through line 38 and mixed with the solids of the filter cake, previously described, which are fed through line 17, the mixture then being fed to a residue stripper mixer 39. Additional water may also be added to the solids mixture by means of line 40 so as to maintain a flowable slurry. It has been found that a slurry containing only two pounds of water per pound of diatomite when agitated will set up and become immobile. Sufficient water must be present prior to stripping the spent diatomite so that the slurry will not set up. About three parts by weight water per part by weight of spent diatomite suffice. This amount of water may either be added in its entirety during solvent disengagement in disengager 36 or additional water can be added as through line 40 prior to stripping solvent from the spent diatomite. Make-up water for the entire process is conveniently added through line 40*a*.

The aqueous slurry of spent diatomite from the residue stripper mixer 39 is next stripped of residual solvent by contact with steam at superatmospheric pressure. Mixed slurry flows through line 41, through a heat exchanger 42, and through line 43 to a residue stripper 44. Stripping of the residual solvent from spent diatomite is effected by countercurrently contacting the spent ore with steam charged to the stripper through line 45.

A preferred apparatus for such stripping comprises a nearly horizontal cylinder, or kiln, fitted with lifting flights and rotating about its axis. Such kilns are used in cement manufacture, and the like, where large tonnages of material are processed. The major difference in construction of the residue stripper as compared with a cement kiln arises from the requirement that the rotating cylinder must have seals at each end where the rotor abuts the stationary ends. Such construction is not commonplace, but such seals have been successfully employed.

Aqueous diatomite slurry has a tendency to foam when steam is sparged through it as in an autoclave, whereas in the preferred rotary kiln, where sheets of slurry that fall from the lifting flights are parallel to the axial direction of the flow of steam, little tendency to foam is encountered.

In laboratory stripping of solvent from aqueous slurries of spent diatomite, it was found that stripping was relatively slow, presumably because solvent is strongly absorbed in the hollow diatom skeletons. Hydrocarbon components of the solvent boiling above 210° F. were particularly difficult to remove. Even when the entire solvent boiled below 210° F., stripping at atmospheric pressure was too slow to be practical. Stripping pressures between 50 and 150 psig were satisfactory, since transfer of solvent to the stripping steam was more rapid at the higher temperatures corresponding to superatmospheric pressure. Since superatmospheric stripping of slurries is practical, elevated pressure is not disadvantageous. In fact, pressure stripping would in any case have to be employed in a commercial process, since it is essential that energy be conserved by reusing heat in the vapor from the residue stripper by condensing the vapor in first effect evaporator 56 and heat exchanger 7, as later described.

Slurry from the kiln, stripped of solvent, discharged through line 46 is advantageously used in the heat exchanger 42 to heat incoming aqueous slurry to the stripper. After the slurry has been cooled by heat exchange, it is charged by line 47 to a final filter 48 where as much water as possible is reclaimed for reuse in the process. Reclaimed water may, for example, be carried by line 49 to line 40 for use in the residue stripper, or to line 50 which leads to line 34 for addition to water fed to the disengager mixer 33 through line 34. The wet filter cake is then discharged as at 51, preferably for return to the mine as fill.

The mixture of steam and residual solvent which is stripped from the aqueous slurry of diatomite in the residue stripper 44 flows through line 52 and heat is recovered from the vapor mixture as hereinafter described.

In the separation and recovery of solvent and oil from the extraction process, an evaporation system is used to recover oil from the overflow from the clarifier in line 15 and the filtrate in line 14 which are combined in line 16, the contents thereof being oil, solvent and a minor amount of wet diatomite fines. The first steps of the evaporation system comprise a double effect evaporator with counterflow of liquid and vapor, the first effect evaporator 56 operating at superatmospheric pressure, and the second effect evaporator 53 at a lower pressure, preferably atmospheric. From line 16, this mixture is fed into the bottoms of the tubes **53*a* of the second effect evaporator 53, to which jacket heat is applied. Solvent vapor exits the top of the evaporator through line 54. A portion of the solvent condensed from this vapor is refluxed to the top of the evaporator 56, as hereinafter explained. Partially concentrated miscella flows from evaporator 53 through line 55 into the bottoms of the jacketed tubes 56*a* of the first effect evaporator 56. Solvent vapor exiting the top of first effect evaporator 56 through line 57 is condensed in the heating jacket of the second effect evaporator 53, thus providing heat for solvent vaporization in the tubes 53*a* of the evaporator. Condensed solvent leaving the jacket of evaporator 53 in line 58 is split into two portions, the major portion recycling to the extractor through line 92, and the minor portion refluxing to the top of evaporator 56 through line 59** as hereinafter explained.

Heat for the first effect evaporator is preferably supplied by a portion of the vapors from the residue stripper which are received from line 52 and charged to the heating jacket of the first effect evaporator 56 through line 60. Partially concentrated miscella containing oil and solvent from the first effect evaporator 56 is fed through line 61 to a final evaporator 62, which may operate at the same pressure as the second effect evaporator. Solvent is boiled from the miscella in tubes **62*a*. Steam is fed to the evaporator jacket through line 63; condensed steam is discharged through line 64. Concentrated miscella containing oil and minor amount of solvent is discharged from the final evaporator 62 through line 65**.

The last of the solvent is removed from the oil in oil stripper 66. Concentrated miscella enters at the top of the stripper and flows down the trays **66*a*, while in countercurrent contact with steam which enters the bottom of the stripper through line 67. Vapor exiting the stripper in line 68 joins in line 71 with the vapor from the final evaporator 62 in line 70. Crude oil, essentially free of solvent, exits the bottom of the stripper in line 69**.

The crude oil with which the diatomite ore is impregnated will, in general, have components boiling as low as 400° F., and the term low boilers as used herein is used to designate those components of the oil which have a boiling point below about 500° F. These components have a volatility as compared with a hydrocarbon solvent boiling at about 200° F. which must be taken into account, since it is essential that the condensed solvent that is recycled to the extractor be free of these components. Consequently, provision is made in the evaporation system for freeing the solvent vapor distilled in the evaporators of these low boiling components.

This is accomplished by the fractionation means which are included in the evaporators 53 and 56, and by a still 72. Evaporator 53 is portrayed as having mounted above the evaporator section a distillation column equipped with conventional bubble cap or sieve trays **53*b*. Likewise there is a distillation zone in the top of evaporator 56 portrayed as having in it distillation trays 56*b*. In operation, vapor in line 54 combined with vapor in line 77, both vapors comprising solvent with very little low boilers plus water vapor, join in line 78, and are condensed in condenser 79. Condensate in line 80 flows to a decanter 81 in which solvent, the lighter phase, is separated from water. A portion of the solvent overflowing the decanter in line 83 refluxes through line 86 to the top of the rectification section of evaporator 53. Thus, by conventional rectification with reflux, the low boiling components of the crude oil which are vaporized in the evaporation section of 53 are cleansed from the vapor, so that vapor leaving the evaporator in line 54 is substantially free of low boilers. Likewise, vapor from the evaporator 56 flows through line 57 to the heating jacket of the evaporator 53 where the vapor is consensed. A portion of the condensate exiting the jacket in line 58 is refluxed to the top of the rectification column of evaporator 56**, so as to cleanse the vapor rising from the evaporator tubes of their content of low boilers.

As the evaporation proceeds, the concentration of low boilers, those components boiling below about 500° F., in the vapor leaving the tubes of each successive evaporator in the direction of miscella flow increases. Thus, concentration of low boilers in the vapor leaving the tubes at **56*c* of evaporator 56 is higher than that in the vapor leaving the tubes 53*c* of evaporator 53; and the concentration of low boilers in the vapor in line 70 leaving the tubes of evaporator 62 is higher than that in the vapor leaving the tubes 56*c* of evaporator 56. For the same reason, the concentration of low boilers relative to solvent in the vapor in line 68 leaving the oil stripper 66 is higher than the concentration of low boilers in the vapor leaving the tubes in evaporator 62. Since it is contemplated that the operating pressure in evaporator 62 and in the stripper 66 will be the same, preferably atmospheric pressure, it is convenient to have the vapor in line 70 leaving the evaporator 62 and the vapor in line 68 leaving the stripper 66 join in line 71 and be fed to a fractionating column 72**.

Column 72 is a conventional distillation column in which vapor to be fractionated is fed at a point intermediate the top and bottom, part of the distillate is refluxed to the top, and reboiled vapor is refluxed to the bottom. Since the vapor flow rate above the feed point is much higher than the vapor flow rate below, the column is portrayed in the drawing as having a greater diameter in its upper section than in its lower section. Feed entering in line 71 comprising solvent, low boilers and water vapors, mixed with vapor from below the feed point, rises through trays 72a countercurrent to reflux fed in line 85. Vapor, substantially free of low boilers, exiting in line 77, mixed with vapor in line 54, flows to the condenser 79 through line 78. Condensate in line 80 flows to the separator 81, where the immiscible hydrocarbon solvent is separated from water. Solvent overflowing the separator in line 83 is divided into three streams: stream 85 provides reflux for column 72; stream 86 provides reflux for evaporator 53; and stream 84 recycles to the extractor. Water underflowing separator 81, through line 82, is shown joining stream 17 as part of the feed to the residue stripper mixer 39.

Bottoms from column 72 flow through line 73 to the reboiler 74. Since the pressure in the column may be at or only slightly below atmospheric, the boiling point of the low boilers from the crude oil in the reboiler 74 may be in excess of 400° F. Consequently, it may be necessary to heat the reboiler with circulating hot oil or the like. Vapor generated in the reboilers enters column 72 through line 76; bottoms from the reboiler, comprising low boilers from the crude oil substantially free of solvent, exit through line 75.

In the entire solvent recovery system as so far described, there are three sources of heat not yet utilized which may be advantageously employed for preheating the diatomite ore to the extraction temperature. These are: the vapor from the residue stripper in line 52 in excess of that used to heat the first effect evaporator 56; hot condensate in line 87 from the jacket of the first effect evaporator 56; and condensate in line 92 from the jacket of the second effect evaporator 53. The latter two have heat in them available for heating the feed because they result in condensate vapor under superatmospheric pressure at a temperature well above the extraction temperature. Slurry in line 5 from the feed mixer 4 is heated first in heat exchanger 6 by hot solvent from line 92. The slurry is further heated in heat exchanger 7 by a mixture of vapor from line 52 and hot condensate of the same composition from line 87. The desired temperature of the slurry in line 5 leaving heat exchanger 7 is an optimum extraction temperature slightly below the boiling point of the heterogeneous azeotrope of solvent and water.

Condensate in line 88 comprising solvent and water is separated in separator 89 into solvent overflowing to line 91 and water underflowing in line 90. Likewise, solvent in line 93, which may contain some water, is separated in separator 94 into solvent overflowing to line 96 and water underflowing to line 95. Solvent stream in line 91 joins solvent stream in line 96 and the combined streams are further cooled in exchanger 97 to the desired extraction temperature. Cooled solvent recycles to the extractor. The water streams from the two separators are joined in line 95, and may be used as part of the water added ahead of the diatomite residue mixer 39.

The properties desired of the solvent are that it dissolve crude oil completely and rapidly, and be completely recoverable by distillation from crude oil and spent diatomite. Hydrocarbons boiling below 250° F. may be used, with those ranging in boiling point between 150° and 250° F. preferred, which hydrocarbons form a heterogeneous azeotrope with water. The most preferred solvent is a hydrocarbon fraction boiling between 170° and 210° F., and containing at least 30 percent of cyclic compounds. The boiling point of the heterogeneous azeotrope of this most preferred solvent with water is about 175° F. The corresponding preferred extraction temperature is between 160° and 170° F.

EXAMPLE

In a plant designed to produce 25,000 bbls./day of crude oil, diatomaceous ore comprising 11.9% crude oil, 33.9% water and 54.3% diatomite is to be extracted by the process of this disclosure using a hydrocarbon solvent boiling over the range of 170°–210° F. The initial point of the crude oil is about 400° F., with low boilers considered to be the components boiling below about 500° F. amounting to about 5% of the crude oil. In the following table, flows, calculated for plant design from laboratory data, of solvent, water, oil and diatomite in several of the numbered lines of the drawing are given in 1,000 lbs./hr. "Oil" in the table is total crude oil in the stream minus low boilers.

| STREAM | SOLVENT | WATER | OIL | LOW BOILERS | DIATOMITE |
|---|---|---|---|---|---|
| 1 | | 1,050 | 351 | 18.6 | 1,680 |
| 16 | 1,230 | 7 | 338 | 17.8 | 5 |
| 32 | 2,323 | 996 | 50.3 | 2.7 | 1,584 |
| 34 | | 2,172 | | | |
| 38 | 620 | 3,168 | 13.3 | 0.7 | 1,584 |
| 41 | 687 | 4,960 | 14.2 | 0.8 | 1,675 |
| 51 | 0.2 | 2,288 | 14.2 | 0.8 | 1,675 |
| 53c | 400 | | | 0.2 | |
| 55 | 801 | | 338 | 17.7 | 5 |
| 56c | 520 | | | 0.9 | |
| 61 300 | | 338 | 17.7 | 5 | |
| 65 | 33 | | 266 | 14.7 | 5 |
| 68 | 33 | 9.6 | | 3.9 | |
| 69 | 0.3 | | 338 | 10.9 | 5 |
| 70 | 266 | | 3.1 | | |
| 75 | 0.1 | | | 6.9 | |
| 84 | 1,820 | | | 0.1 | |

Comparison of solvent in line 38 and 32 demonstrates the efficacy of solvent disengaging in the solvent disengager 36. Reduction of crude oil (oil plus low boilers) in the diatomite exiting the system in line 51 to 15,000 lbs./hr. from the initial crude oil content of 370,000 lbs./hr. in the ore entering the system in line 1 demonstrates the efficacy of 6-stage extraction. Despite the ever increasing amounts of low boilers in the vapors 53c, 56c and 70 from the tubes of the evaporators, 53, 56 and 62 respectively and in the vapor stream 68 from the oil stripper 66, the evaporation system recovers solvent substantially free of low boilers.

The multiple-effect evaporation process described by the drawing is applicable wherever a relatively volatile solvent is to be separated from a liquid solute which has a major portion of relatively non-volatile components and a minor portion of components which are relatively volatile, with respect to but higher boiling than the solvent. The evaporation process is exemplified in this disclosure by almost complete separation of solvent from a solution wherein the solvent boils below 250° F., and the solute is a crude oil, with an initial boiling point of 400° F., which contains 5% of "low boilers" boiling between 400° and 500° F. However, it will be apparent to those skilled in the art of evaporation that the process described by the drawing, wherein the vapor generated in each evaporator flows to a fractional distillation zone wherein the vapors countercurrently contact a reflux stream comprising a portion of the condensate made by condensing the vapor leaving the fractional distillation zone, and the liquid leaving the fractional distillation zone combines with the liquid leaving that evaporator, has general application.

What is claimed is:

1. A process for continuous extraction of oil from diatomite ore with a hydrocarbon solvent comprising:
(a) mixing oil-containing diatomite ore and a second miscella previously produced in the operation of the process to form a slurry;
(b) charging the slurry to a settling zone wherein a first miscella, containing oil and solvent and ore fines, is separated from the diatomite;
(c) contacting said separated diatomite with solvent in a plurality of countercurrent extraction stages and extracting oil therefrom, and separating a second miscella, containing oil and solvent, from spent diatomite containing residual solvent;
(d) returning the second miscella to step (a) for mixing with oil-containing diatomite ore;
(e) intimately mixing the spent diatomite containing residual solvent with water;
(f) separating the mixture so formed into two phases, a heavier phase comprising an aqueous slurry of spent diatomite containing a minor amount of solvent and a lighter solvent phase;
(g) stripping the minor amount of solvent from said aqueous slurry of spent diatomite as a first vapor by contact with steam at superatmospheric pressure;
(h) condensing the mixture of first solvent vapor and steam removed by said stripping and separating the condensate into water and recovered solvent phases;
(i) evaporating solvent from said first miscella as a second solvent vapor, to recover substantially solvent free oil;
(j) condensing the second solvent vapor; and
(k) returning said lighter solvent phase of step (f) and the first and second condensed solvent vapors to the countercurrent extraction stages.

2. The process for continuous extraction of oil from diatomite ore as defined in claim 1 wherein said spent diatomite containing residual solvent is intimately mixed with water in an amount to provide at least two parts by weight water per part by weight of spent diatomite.

3. The process for continuous extraction of oil from diatomite as defined in claim 1 wherein said aqueous slurry of spent diatomite contains at least three parts by weight water per part of spent diatomite during said contact with steam at superatmospheric pressure.

4. The process for continuous extraction of oil from diatomite ore as defined in claim 1 wherein said minor amount of solvent is stripped from said aqueous slurry of spent diatomite by contact with steam at a pressure of between 50–150 psig.

5. The process for continuous extraction of oil from diatomite ore as defined in claim 1 wherein said slurry formed in step (a) is heated, and wherein at least a portion of the heat required to heat said slurry is derived, by indirect heat exchange, from the heat given up by a portion of the vapor condensing in step (h).

6. The process for continuous extraction of oil from diatomite ore as defined in claim 1 wherein at least a portion of the heat required to evaporate solvent from said first miscella in step (i) is derived, by indirect heat exchange, from the heat given up by a portion of the vapor condensing in step (h).

7. The process for continuous extraction of oil from diatomite ore as defined in claim 1 wherein said solvent comprises hydrocarbons boiling point between 170° and 210° F.

8. The process for continuous extraction of oil from diatomite ore as defined in claim 7 wherein said solvent contains at least 30 percent by weight of cyclic hydrocarbons.

9. The process for continuous extraction of oil from diatomite ore as defined in claims 7 or 8 wherein said slurry is heated to a temperature between 160°–165° F.

10. The process for continuous extraction of oil from diatomite ore as defined in claim 1 wherein the slurry is heated and the extraction temperature is 5°–15° below the boiling point of the heterogeneous azeotrope of said hydrocarbon solvent.

11. The process for continuous extraction of oil from diatomite ore as defined in claim 1 wherein ore fines in said first miscella from the settling zone are separated therefrom and combined with said spent diatomite containing residual solvent prior to intimate mixing of said spent diatomite with water.

12. A process for the recovery of a hydrocarbon solvent from spent diatomite resulting from the solvent extraction of oil from a diatomite ore comprising:
(a) intimately mixing said spent diatomite containing solvent with at least two parts by weight of water per part of diatomite;
(b) separating the mixture so formed into two phases, a heavier phase comprising an aqueous slurry of spent diatomite containing a minor amount of solvent and a lighter solvent phase;
(c) stripping the minor amount of solvent from said aqueous slurry of spent diatomite by contact with steam at superatmospheric pressure; and
(d) recovering said solvent.

13. The process for the recovery of a hydrocarbon solvent from spent diatomite as defined in claim 12 wherein said aqueous slurry of spent diatomite contains at least three parts by weight water per part of spent diatomite during said contact by steam at superatmospheric pressure.

14. The process for recovery of a hydrocarbon solvent from spent diatomite as defined in claim 12 wherein said minor amount of solvent is stripped from said aqueous slurry of spent diatomite by contact with steam at a pressure of between 50–150 psig.

15. The process for recovery of a hydrocarbon solvent from spent diatomite as defined in claim 12 wherein said solvent comprises hydrocarbons boiling between 170° and 210° F.

16. The process for recovery of a hydrocarbon solvent from spent diatomite as defined in claim 12 wherein aqueous slurry of spent diatomite following stripping of solvent therefrom is passed in heat exchange relationship to further aqueous slurry containing a minor amount of solvent to heat the same prior to stripping of solvent from said further aqueous slurry.

17. The process for recovery of a hydrocarbon solvent from spent diatomite as defined in claim 12 wherein water is recovered from said aqueous slurry of spent diatomite following said passage in heat exchange relationship and said recovered water is intimately mixed with further spent diatomite containing solvent.

* * * * *